US007726284B2

(12) United States Patent
Hori

(10) Patent No.: US 7,726,284 B2
(45) Date of Patent: Jun. 1, 2010

(54) FUEL SUPPLY SYSTEM OF INTERNAL COMBUSTION ENGINE

(75) Inventor: Yasuyoshi Hori, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 468 days.

(21) Appl. No.: 11/305,030

(22) Filed: Dec. 19, 2005

(65) Prior Publication Data

US 2006/0157032 A1 Jul. 20, 2006

(30) Foreign Application Priority Data

Jan. 14, 2005 (JP) ..... 2005-007760

(51) Int. Cl.
*F02M 37/04* (2006.01)

(52) U.S. Cl. ..... 123/501; 123/458; 123/500; 123/506

(58) Field of Classification Search ..... 123/501, 123/500, 494, 446, 456, 467, 357, 506, 514, 123/458, 495, 447; 73/119 A
See application file for complete search history.

(56) References Cited

U.S. PATENT DOCUMENTS

| | | | | | |
|---|---|---|---|---|---|
| 4,590,908 | A | * | 5/1986 | Yoshinaga et al. | 123/357 |
| 4,766,864 | A | * | 8/1988 | Ban et al. | 123/357 |
| 4,788,960 | A | * | 12/1988 | Oshizawa | 123/506 |
| 4,838,232 | A | * | 6/1989 | Wich | 123/506 |
| 5,277,156 | A | * | 1/1994 | Osuka et al. | 123/198 DB |
| 5,370,095 | A | * | 12/1994 | Yamaguchi et al. | 123/446 |
| 5,678,521 | A | * | 10/1997 | Thompson et al. | 123/447 |
| 5,697,347 | A | * | 12/1997 | Enomoto et al. | 123/502 |
| 5,706,780 | A | * | 1/1998 | Shirakawa | 123/381 |
| 6,189,514 | B1 | * | 2/2001 | Shioi et al. | 123/502 |
| 6,871,633 | B1 | * | 3/2005 | Date et al. | 123/447 |
| 2004/0011325 | A1 | * | 1/2004 | Benson et al. | 123/299 |

FOREIGN PATENT DOCUMENTS

| | | | | |
|---|---|---|---|---|
| DE | 100 23 227 | A1 | | 11/2001 |
| DE | 101 37 869 | A1 | | 2/2003 |
| DE | 103 60 332 | A1 | | 7/2005 |
| DE | 10/2004 048 957 | A1 | | 11/2005 |
| JP | 4334740 | | * | 11/1992 |
| JP | 2836282 | B2 | | 10/1998 |
| JP | 2001-82230 | A | | 3/2001 |
| JP | 2003-41985 | A | | 2/2003 |
| WO | 0186131 | | * | 11/2001 |

* cited by examiner

*Primary Examiner*—Stephen K Cronin
*Assistant Examiner*—J. Page Hufty
(74) *Attorney, Agent, or Firm*—Sughrue Mion, PLLC

(57) ABSTRACT

The fuel supply system of an internal combustion engine includes an electronic control unit (ECU) for transferring the engine from a state in which a high-pressure fuel pump does not deliver any pressurized fuel to a state in which the high-pressure fuel pump begins to deliver the pressurized fuel by gradually varying an output period of a drive signal for controlling opening/closing behavior of a solenoid valve while monitoring changes in fuel pressure detected by a pressure sensor, and for estimating a mounting error between angular mounting positions of the high-pressure fuel pump and a pump actuating cam with reference to a rotation signal from a state of the solenoid valve drive signal when a change in the fuel pressure has been detected. The solenoid valve drive signal is corrected based on the value of the mounting error estimated by the ECU.

13 Claims, 10 Drawing Sheets

FUEL SUPPLY SYSTEM OF INTERNAL COMBUSTION ENGINE

BACKGROUND OF THE INVENTION

1. Field of the Invention

The present invention relates generally to a fuel supply system for an internal combustion engine of a vehicle and, more particularly, to a fuel supply system for regulating the quantity of fuel supplied to a fuel injector in a direct injection internal combustion engine to which fuel must be supplied at a high pressure.

2. Description of the Background Art

Conventionally, an electronically controlled fuel supply system used in an internal combustion engine of a motor vehicle includes a plurality of fuel injectors for injecting fuel into individual cylinders of the engine, a delivery pipe for feeding the fuel to the fuel injectors, a high-pressure fuel pump for feeding the pressurized fuel to the delivery pipe, a low-pressure fuel pump for feeding the fuel from a fuel tank to the high-pressure fuel pump, and a controller for controlling such parameters as fuel injection timing and injection quantity as well as discharge rate of the high-pressure fuel pump.

The aforementioned high-pressure fuel pump includes a cylinder, a pump piston and a solenoid valve. Controlled by a pump actuating cam fitted on a rotary shaft of the internal combustion engine, such as a camshaft, the pump piston reciprocates inside the cylinder, whereby the high-pressure fuel pump draws the fuel into a pressure chamber formed between the cylinder and the pump piston in each successive intake stroke and delivers the pressurized fuel from the pressure chamber to the delivery pipe in each successive output stroke. In the high-pressure fuel pump thus structured, the solenoid valve relieves the pressure of the pressurized fuel in the pressure chamber to a low-pressure side with specific timing to thereby regulate the quantity of fuel discharged from the pressure chamber, so that the fuel in the delivery pipe is maintained at a specific pressure level.

The fuel in the delivery pipe is normally held at the specific pressure level as the solenoid valve regulates the rate of fuel discharge from the pressure chamber as mentioned above. If it becomes impossible to properly regulate fuel pressure in the delivery pipe, however, the fuel injectors would not be able to inject the fuel in an optimal state and this makes it impossible to produce a mixture of a desired condition. Should such a situation occur, it is likely that combustion efficiency of the internal combustion engine drops, resulting in deterioration of running performance of the vehicle, or harmful emission gases are released from the engine. Thus, it is important that the solenoid valve properly regulate the quantity of fuel discharged from the pressure chamber all the time.

It is necessary to control the solenoid valve in such a manner that the solenoid valve opens and closes with proper timing according to the amount of lift of the pump actuating cam. Thus, in a prior art arrangement, a sensing signal of a crank angle sensor for detecting crank angle, or the angular position of a crankshaft, is used as a rotational position signal indicating the angular position of the pump actuating cam for controlling open/close timing of the solenoid valve.

If there is an error in mounting position of the high-pressure fuel pump or the pump actuating cam is mounted on other than the crankshaft, causing an error in angular position between the crankshaft and the pump actuating cam, however, the sensing signal output from the crank angle sensor would not indicate the correct angular position of the pump actuating cam. This would make it impossible to properly control the open/close timing of the solenoid valve.

A previous approach to the resolution of the aforementioned problem is found in Japanese Patent No. 2836282 which describes a fuel injection system provided with a delivery pipe, wherein an error in angular position between a crankshaft and a pump actuating cam is corrected based on a phase difference between a sensing signal output from a cam angle sensor mounted at the pump actuating cam and a sensing signal output from a crank angle sensor.

Another previous approach to the resolution of the aforementioned problem is found in Japanese Patent Application Publication No. 2003-41985. Although this Publication does not include a description with respect to the position of a pump actuating cam, a fuel injection system disclosed in the Publication has a capability to detect a delivered fuel quantity property corresponding to operating conditions from changes in fuel pressure occurring in response to a delivered fuel quantity command given at engine start.

The aforementioned fuel injection system of Japanese Patent No. 2836282 can correct the error in angular position occurring between the crankshaft and the pump actuating cam by using the detected phase difference between the sensing signal of the cam angle sensor and the sensing signal of the crank angle sensor. If there is an error in relative mounting position of a high-pressure fuel pump and the pump actuating cam, however, the fuel injection system of Japanese Patent No. 2836282 can not correct this error and this potentially causes an error in the quantity of fuel delivered by the high-pressure fuel pump. This is because the fuel injection system simply detects the phase difference between the sensing signals of the cam angle sensor and the crank angle sensor. If the fuel pressure in the delivery pipe can not be regulated to a specific level, fuel injectors would not be able to inject the fuel in an optimal state and produce a mixture of a desired condition. Should this situation occur, combustion efficiency of the internal combustion engine may drop, resulting in deterioration of vehicle running performance or of exhaust gas quality.

The fuel injection system disclosed in Japanese Patent Application Publication No. 2003-41985 detects the delivered fuel quantity property at engine start under conditions involving the influence of engine operating conditions, such as engine temperature, in addition to variations in individual system parameters. Although the fuel injection system of Japanese Patent Application Publication No. 2003-41985 can regulate the quantity of fuel delivered by the high-pressure fuel pump with high precision at engine start, the quantity of the actually delivered fuel varies with changes in engine operating conditions after engine start, such as an increase in engine temperature. Therefore, an error is likely to occur in the detected delivered fuel quantity property.

SUMMARY OF THE INVENTION

The present invention is intended to solve the aforementioned problem of the prior art. Accordingly, it is an object of the invention to provide a fuel supply system for an internal combustion engine which can control a solenoid valve with high accuracy and reduce an error in the quantity of fuel delivered by a high-pressure fuel pump based on an estimation of a relative mounting error between the high-pressure fuel pump and a pump actuating cam.

According to the invention, a fuel supply system of an internal combustion engine includes a delivery pipe for feeding pressurized fuel to a fuel injector for injecting the fuel into each cylinder of the engine, a high-pressure fuel pump driven by movements of a pump actuating cam which is caused to rotate by energy imparted by the engine for delivering the pressurized fuel into the delivery pipe, a solenoid valve for regulating the quantity of fuel delivered by the high-pressure fuel pump, a fuel pressure sensor for detecting fuel pressure within the delivery pipe, a rotation signal generator for generating a rotation signal in accordance with rotation of the engine, and a solenoid valve controller for generating a solenoid valve drive signal for controlling opening/closing behavior of the solenoid valve using the rotation signal as a reference so that the high-pressure fuel pump delivers a quantity of fuel appropriate for current operating conditions of the engine. The fuel supply system further includes a mounting error estimator for transferring the engine from a state in which the high-pressure fuel pump does not deliver any pressurized fuel to a state in which the high-pressure fuel pump begins to deliver the pressurized fuel by gradually varying a solenoid valve drive signal output period while monitoring changes in the fuel pressure detected by the fuel pressure sensor, and for estimating a mounting error between angular mounting positions of the high-pressure fuel pump and the pump actuating cam with reference to the rotation signal from a state of the solenoid valve drive signal when a change in the fuel pressure has been detected. In this fuel supply system of the invention, the solenoid valve controller makes a correction to the solenoid valve drive signal in accordance with the value of the mounting error estimated by the mounting error estimator.

In the fuel supply system of the invention thus configured, the solenoid valve controller corrects the solenoid valve drive signal in accordance with the value of the mounting error estimated by the mounting error estimator, so that the solenoid valve can be actuated without the influence of the mounting error occurring between the angular mounting positions of the high-pressure fuel pump and the pump actuating cam with reference to the rotation signal. Consequently, the quantity of fuel to be delivered by the high-pressure fuel pump is calculated with high accuracy at all times and, therefore, it is possible to constantly regulate the fuel pressure within the delivery pipe to a specific level. As a result, the fuel supply system produces optimum fuel injection to create an air-fuel mixture of a desired condition which can be combusted in a desirable fashion, making it possible to achieve high running performance and prevent deterioration of exhaust gas quality.

In particular, if a period during which the mounting error estimator monitors changes in the fuel pressure detected by the fuel pressure sensor is made equal to a period during which the fuel injector is not actuated, it is possible to conveniently monitor changes in the fuel pressure with higher accuracy without the influence of fuel pressure variations caused by fuel injection.

These and other objects, features and advantages of the invention will become more apparent upon reading the following detailed description in conjunction with the accompanying drawings.

DESCRIPTION OF THE PREFERRED EMBODIMENTS

The invention is now described in detail, by way of example, as being embodied in a fuel supply system of a four-cylinder direct injection internal combustion engine of a motor vehicle.

First Embodiment

Figure 1:
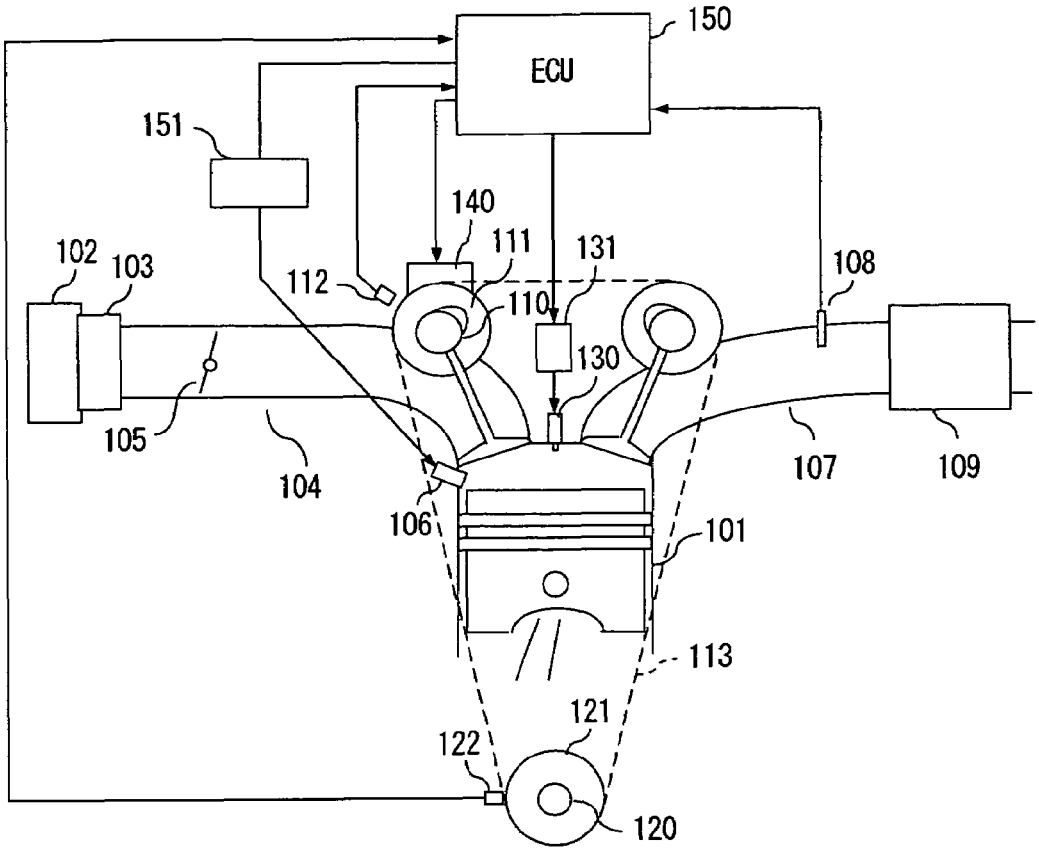
FIG. 1 is a schematic diagram showing the structure of a four-cylinder direct injection internal combustion engine employing a fuel supply system according to a first embodiment of the invention.
Figure 2:
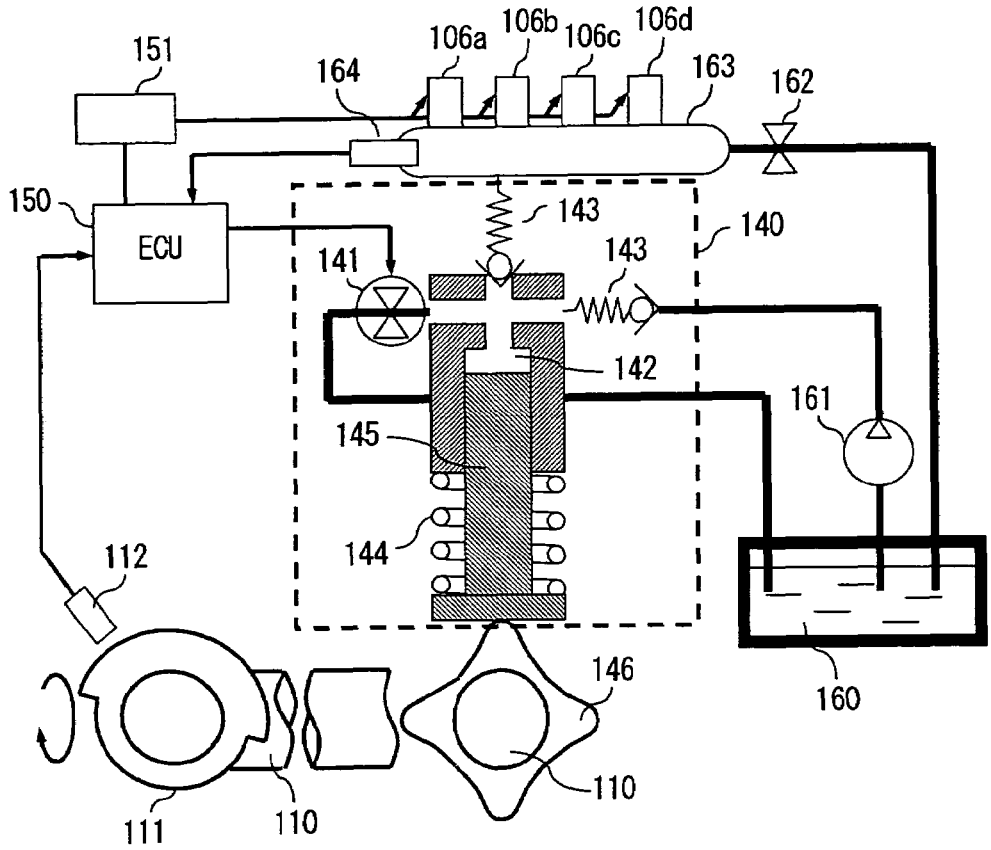
FIG. 2 is a configuration diagram of the fuel supply system of the first embodiment.

FIG. 1 is a schematic diagram showing the structure of a four-cylinder direct injection internal combustion engine 101 employing a fuel supply system according to a first embodiment of the invention, and FIG. 2 is a configuration diagram of the fuel supply system of the first embodiment.

Referring to FIG. 1, the internal combustion engine 101 is provided with an air cleaner 102 for cleaning air drawn into the internal combustion engine 101, an airflow sensor 103 for detecting the amount of intake air drawn into the internal combustion engine 101, an intake pipe 104 for guiding the intake air to the internal combustion engine 101, a throttle valve 105 for regulating the amount of intake air drawn into the internal combustion engine 101, fuel injectors 106 for injecting fuel into individual cylinders of the internal combustion engine 101, and an injector driver 151 for actuating the fuel injectors 106 in such a manner that the fuel is fed in quantities appropriate for current operating conditions of the internal combustion engine 101.

The internal combustion engine 101 is further provided with spark plugs 130 for the individual cylinders, an ignition coil 131 for supplying high voltage to each of the spark plugs 130 for producing an electric spark and thereby igniting an air-fuel mixture created in a combustion chamber formed above a piston in each cylinder, an exhaust pipe 107 for letting exhaust gas out from each combustion chamber, an oxygen sensor 108 for detecting the concentration of oxygen in the exhaust gas, and a three-way catalytic converter 109 for cleaning the exhaust gas.

The internal combustion engine 101 is further provided with a camshaft 110 which is connected to a crankshaft 120 by such mechanical motion transfer means as a timing belt 113. The camshaft 110 turns at half the speed of the crankshaft 120.

Referring to FIG. 1, designated by the numeral 111 is a signal plate mounted on the camshaft 110 for generating a cam signal SGC. For the convenience of explanation to follow in this Specification, the cylinders of the internal combustion engine 101 are hereinafter referred to as the first to fourth cylinders. The signal plate 111 has a projection which causes the cam signal SGC to stay at a high level from top dead center at the end of a compression stroke (hereinafter referred to as compression stroke top dead center) of the first cylinder to compression stroke top dead center of the fourth cylinder. Designated by the numeral 112 is a cam angle sensor for generating the cam signal SGC by detecting the projection of the signal plate 111. Designated by the numeral 121 is a signal plate mounted on the crankshaft 120. The structure of the signal plate 121 will be later discussed in detail. Designated by the numeral 122 is a crank angle sensor for generating a crank angle signal SGT by detecting projections formed on the signal plate 121. The signal plate 121 and the crank angle sensor 122 together constitute a rotation signal generator mentioned in the appended claims.

The aforementioned fuel injectors 106 fitted in the individual cylinders of the internal combustion engine 101 are designated by the reference numerals 106*a*, 106*b*, 106*c* and 106*d*, where necessary, as shown in FIG. 2. Referring to FIG. 2, the fuel supply system includes a high-pressure fuel pump 140 which is provided with a spring 144 for continuously biasing a pump piston 145 in a direction of enlarging a pressure chamber 142 and check valves 143 located at a fuel inlet port and at a fuel outlet port of the high-pressure fuel pump 140. The fuel supply system further includes a pump actuating cam 146 mounted on the camshaft 110. As the internal combustion engine 101 runs, the pump actuating cam 146 turns together with the rotating camshaft 110, causing the pump piston 145 to reciprocate inside a cylinder of the high-pressure fuel pump 140. As a result, the high-pressure fuel pump 140 draws the fuel into the pressure chamber 142 and outputs the fuel pressurized in the pressure chamber 142 into a delivery pipe 163 which will be later discussed.

The high-pressure fuel pump 140 further includes a normally closed solenoid valve 141 which is opened by a signal fed from an electronic control unit (ECU) 150. A valve body of the solenoid valve 141 is so located as to open and close a fuel return line between the pressure chamber 142 and a fuel tank 160. When the solenoid valve 141 opens, the pressurized fuel in the pressure chamber 142 is returned to the fuel tank 160, and a fuel delivery cycle of the high-pressure fuel pump 140 for feeding the fuel to the delivery pipe 163 is brought to an end at this point.

Including a central processing unit (CPU) and a memory, the ECU 150 performs overall control of the internal combustion engine. The solenoid valve 141 of the high-pressure fuel pump 140, the injector driver 151, the cam angle sensor 112 and the crank angle sensor 122 are connected to the ECU 150. The ECU 150 works as a mounting error estimator and as a solenoid valve controller mentioned in the appended claims.

The fuel supply system further includes a low-pressure fuel pump 161 for feeding the fuel from the fuel tank 160 to the high-pressure fuel pump 140. The delivery pipe 163 holds the pressurized fuel fed from the high-pressure fuel pump 140 and supplies the same to the individual fuel injectors 106*a*, 106*b*, 106*c*, 106*d*. A relief valve 162 fitted in a fuel return line between the delivery pipe 163 and the fuel tank 160 serves to release the pressurized fuel from the delivery pipe 163 in case of abnormal fuel pressure buildup in the delivery pipe 163. The delivery pipe 163 is associated with a pressure sensor 164 for detecting the fuel pressure within the delivery pipe 163.

Figure 3:
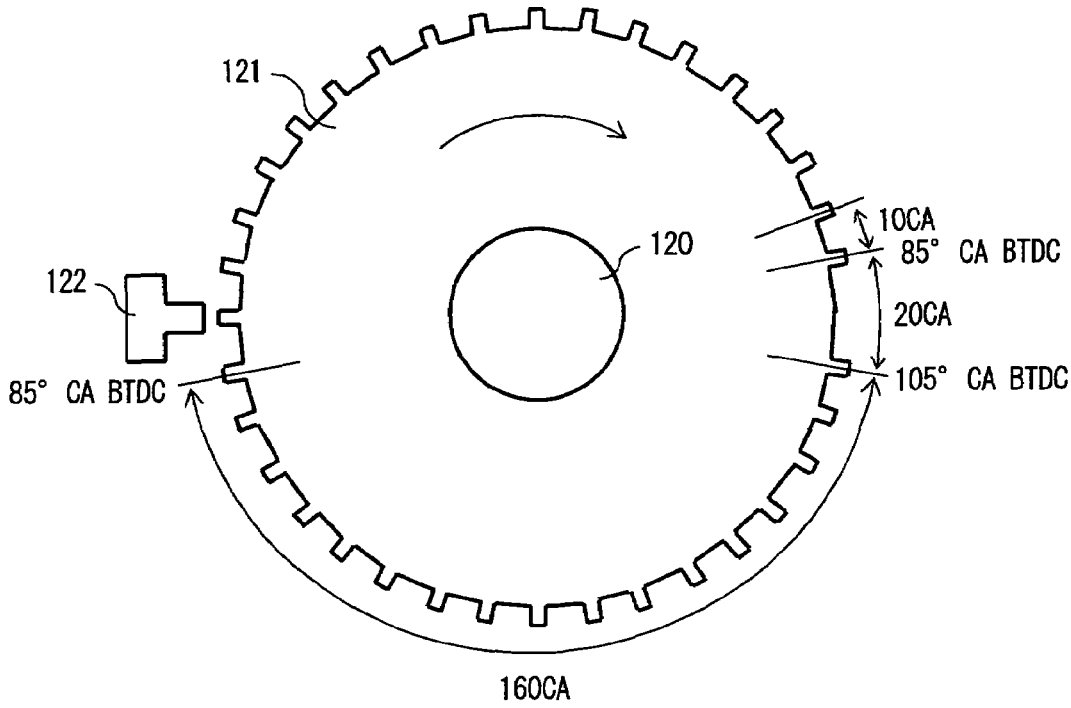
FIG. 3 is a front view specifically showing the structure of a signal plate mounted on a crankshaft.

FIG. 3 is a front view specifically showing the structure of the aforementioned signal plate 121 mounted on the crankshaft 120, in which "CA" stands for crank angle, or the angular position of the crankshaft 120. There are formed 35 projections (or teeth) on an outer periphery of the signal plate 121 at 10° intervals except at a position corresponding to 95° CA before top dead center (hereinafter referred to as 95° CA BTDC) at the end of the compression stroke of the second and third cylinders. The signal plate 121 has no projection at its angular position corresponding to 95° CA BTDC of the piston of either of the second and third cylinders and this untoothed position of the signal plate 121 is used as a reference position.

The crank angle sensor 122 generates the crank angle signal SGT by detecting the teeth of the signal plate 121, so that the untoothed position of the signal plate 121 can be detected by monitoring intervals of successive pulses (which correspond to tooth-to-tooth intervals) of the crank angle signal SGT. Specifically, when the untoothed position of the signal plate 121 comes to the location of the crank angle sensor 122, the crank angle sensor 122 does not produce any pulse (crank angle signal SGT). Thus, the ECU 150 can detect the untoothed position of the signal plate 121 by examining whether the ratio $t(i)/t(i-1)$ of a current pulse interval $t(i)$ of the crank angle signal SGT to a preceding pulse interval $t(i-1)$ thereof exceeds a preset value k. This preset value k is set to 1.5, for instance. Then, when the ratio $t(i)/t(i-1)$ exceeds 1.5, the untoothed position of the signal plate 121 corresponding to 95° CA BTDC of one of the second and third cylinders is just located at the crank angle sensor 122, wherefrom the ECU 150 can determine that the piston of one of the second and third cylinders is at 85° CA BTDC (=95° CA BTDC−10° CA) when a next pulse of the crank angle signal SGT is detected.

Based on whether the cam signal SGC is at the high level or low level when a pulse of the crank angle signal SGT is detected immediately after detection of the untoothed position of the signal plate 121, the ECU 150 can also determine the current crank angle and on which strokes the individual cylinders are. For example, if the cam signal SGC is at the high level when the projection of the signal plate 121 corresponding to the 85° CA BTDC position is detected, the ECU 150 can determine that the pistons of the third cylinder is at 85° CA BTDC.

Figure 4:
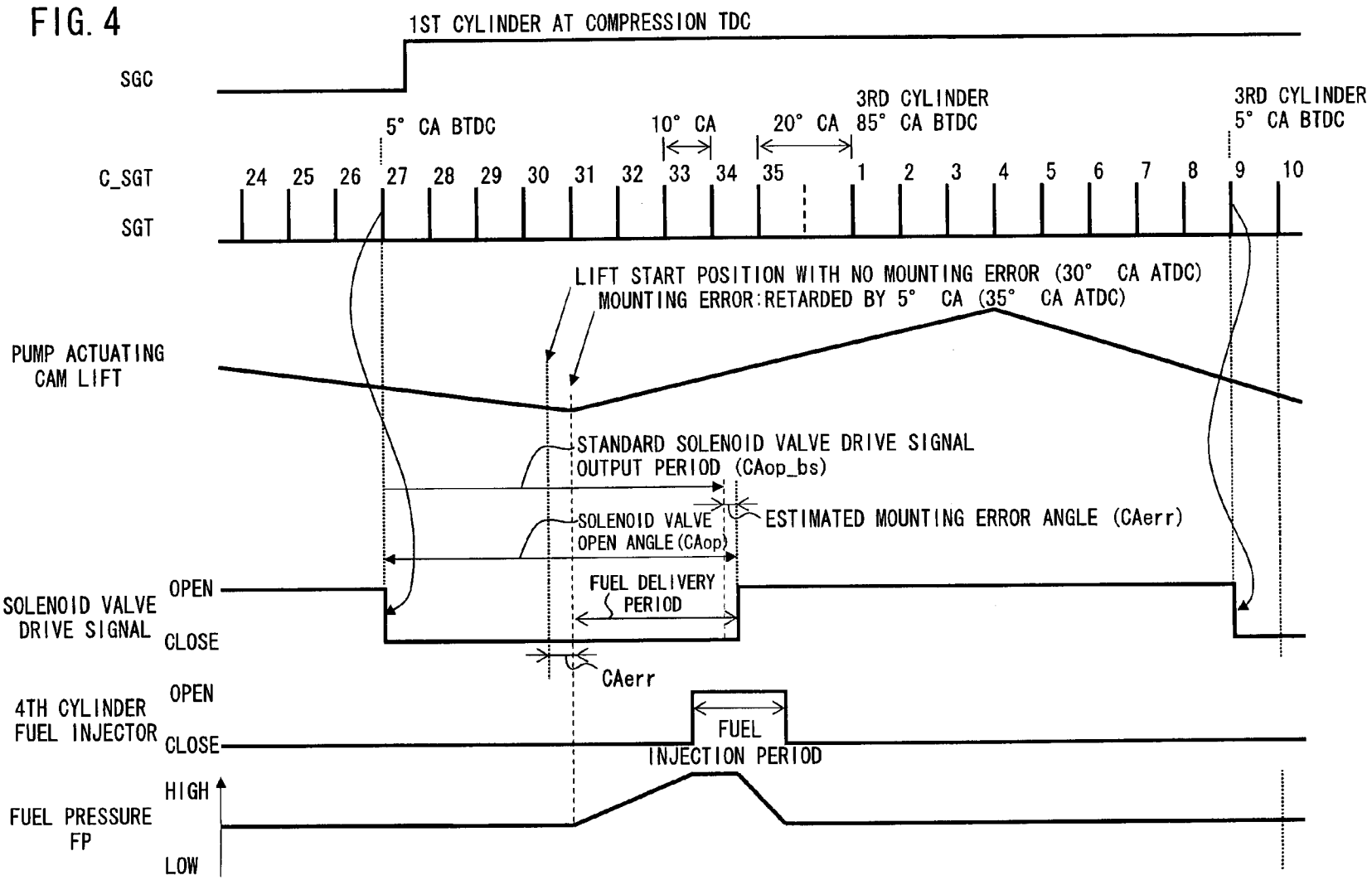
FIG. 4 is a timing chart showing an example of behaviors of various parameters of the four-cylinder direct injection internal combustion engine of the first embodiment under normal operating conditions.

FIG. 4 is a timing chart showing an example of behaviors of various parameters of the four-cylinder direct injection internal combustion engine 101 under normal operating conditions.

Referring to FIG. 4, the level of the cam signal SGC varies as the camshaft 110 rotates, whereas pulses of the crank angle signal SGT are generated as the signal plate 121 mounted on the crankshaft 120 rotates. In the internal combustion engine 101 of the first embodiment, the crank angle signal SGT is used as a rotation signal for actuating the solenoid valve 141 in a controlled fashion.

Designated by C_SGT in FIG. 4 are count values of successive pulses of the crank angle signal SGT used for determining the angular position (crank angle) of the crankshaft 120. The count value C_SGT is incremented each time the crank angle signal SGT is input into a counter configured in the ECU 150, for example. Each time the 85° CA BTDC position is detected at the untoothed position of the signal plate 121, the count value C_SGT is reset to an initial value "1". Thus, while the crankshaft 120 makes one rotation, the count value C_SGT varies from "1" to "35" so that the ECU 150 can determine the angular position of the crankshaft 120 from the count value C_SGT.

Pump actuating cam lift shown in FIG. 4 represents the amount of lift of the pump actuating cam 146 acting on the pump piston 145 of the high-pressure fuel pump 140. The high-pressure fuel pump 140 supplies the fuel to the delivery pipe 163 when the solenoid valve 141 is in a closed position and the pump actuating cam 146 lifts the pump piston 145 upward.

In the internal combustion engine 101 of the first embodiment, when there is no mounting error between the high-pressure fuel pump 140 and the pump actuating cam 146, a lift start position of the pump actuating cam 146 is set at a piston location of 30° CA after top dead center (hereinafter referred to as 30° CA ATDC) for each cylinder. In the example shown in FIG. 4, it is assumed that there is a mounting error of 5° CA toward a retarding side, causing the lift start position of the pump actuating cam 146 to deviate to a 35° CA ATDC position. The amount of this mounting error is however unknown at the beginning of fuel injection control operation. From a practical viewpoint, there is made an assumption that the mounting error should fall within a range of ±10° CA.

While the solenoid valve 141 is opened when a solenoid valve drive signal output from the ECU 150 is at a high level and is closed when the solenoid valve drive signal is at a low level in the illustrated example, there is a certain amount of delay due to response time of the solenoid valve 141 until the solenoid valve 141 reaches the closed position after the solenoid valve drive signal is set to the low level. Taking this delay in the response of the solenoid valve 141 into consideration, the ECU 150 outputs the solenoid valve drive signal at a point before the pump actuating cam 146 begins to lift the pump piston 145. Specifically, the solenoid valve drive signal output timing of the ECU 150 is set at a 5° CA BTDC point.

In a case where there is no mounting error between the high-pressure fuel pump 140 and the pump actuating cam 146, the solenoid valve 141 is controlled to open after a standard solenoid valve drive signal output period CAop_bs has elapsed from the aforementioned 5° CA BTDC point. This arrangement defines operating timing of the high-pressure fuel pump 140 to supply a required quantity of fuel to the delivery pipe 163. The standard solenoid valve drive signal output period CAop_bs is predefined based on experimental data obtained in a design stage, for instance.

In a case where there is a certain amount of mounting error between the high-pressure fuel pump 140 and the pump actuating cam 146, on the other hand, the solenoid valve 141 is controlled to open after a solenoid valve open angle CAop, which obtained by correcting the aforementioned standard solenoid valve drive signal output period CAop_bs by a later described estimated mounting error angle CAerr, has elapsed from the 5° CA BTDC point. Therefore, the solenoid valve open angle CAop after this correction is given by equation (1) below:

$$CAop=CAop_bs+CAerr \quad (1)$$

The standard solenoid valve drive signal output period CAop_bs has a fixed value and, thus, it is apparent from equation (1) above that the solenoid valve 141 can be opened with proper timing to obtain the required quantity of fuel delivery to the delivery pipe 163 if the estimated mounting error angle CAerr is determined with high accuracy.

The estimated mounting error angle CAerr corresponds to an angular position error between the lift start position of the pump actuating cam 146 (30° CA ATDC in the present example) when there is no mounting error between the high-pressure fuel pump 140 and the pump actuating cam 146 and the lift start position of the pump actuating cam 146 when there is a mounting error between the high-sure pressure fuel pump 140 and the pump actuating cam 146. Accordingly, what is essential in the first embodiment is to determine the estimated mounting error angle CAerr by precisely detecting the angular position error in the lift start position of the pump actuating cam 146 occurring due to the presence of a mounting error between the high-sure pressure fuel pump 140 and the pump actuating cam 146.

While the fuel injectors 106 (106*a*-106*d*) inject the fuel in intake strokes of the individual cylinders, FIG. 4 shows a time range during which the fuel injector 106 of only the fourth cylinder injects the fuel.

Designated by Fp in FIG. 4 is fuel pressure within the delivery pipe 163 detected by the pressure sensor 164. The fuel pressure Fp increases when the high-pressure fuel pump 140 delivers the fuel into the delivery pipe 163 and the fuel pressure Fp decreases when the fuel injector 106 injects the fuel.

Figure 5:
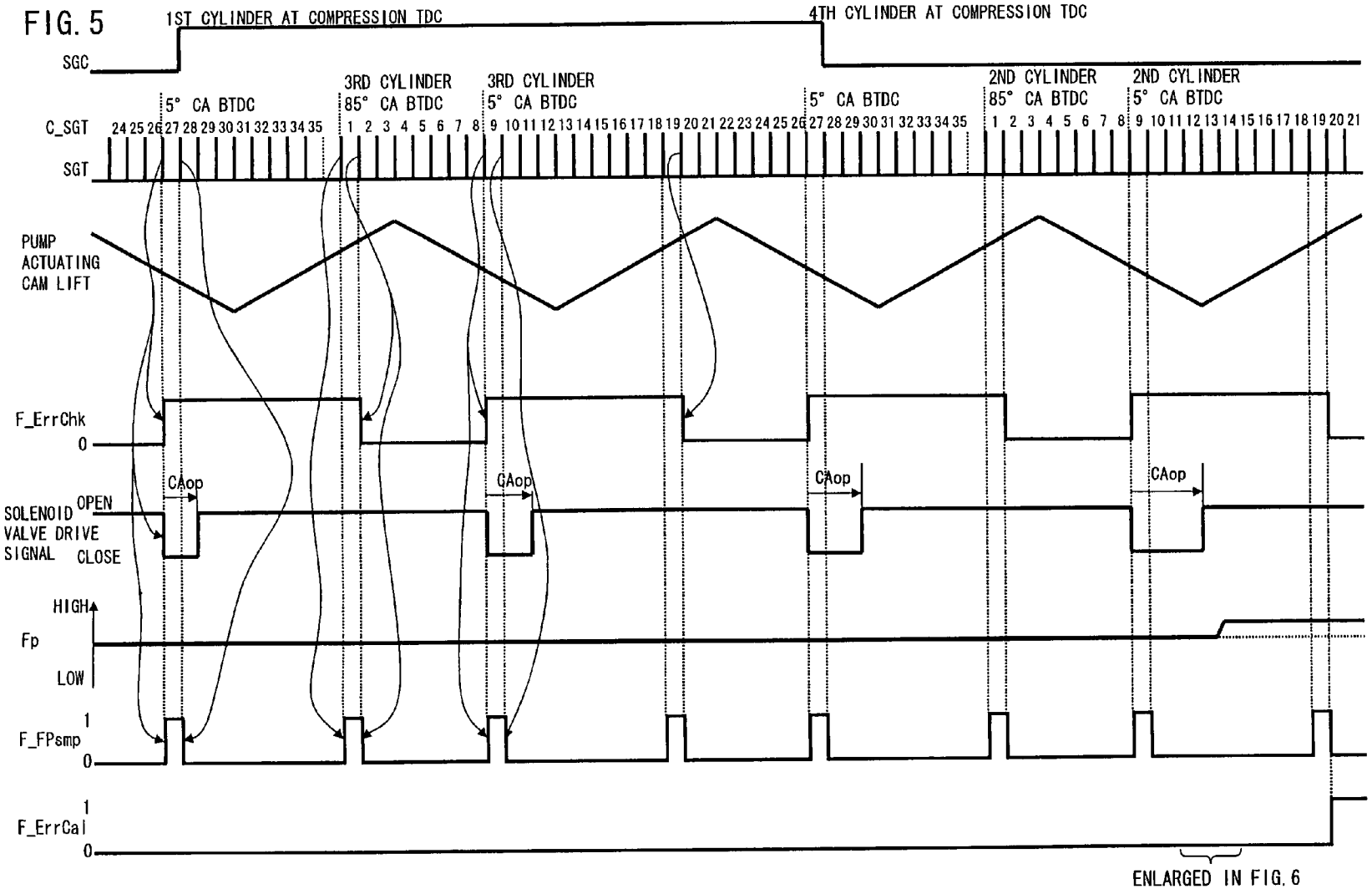
FIG. 5 is a timing chart showing an example of behaviors of various parameters of the four-cylinder direct injection internal combustion engine of the first embodiment used for mounting error estimation process.

FIG. 5 is a timing chart showing an example of behaviors of various parameters of the four-cylinder direct injection internal combustion engine 101 used when determining the estimated mounting error angle CAerr shown in equation (1) above.

The individual parameters shown in FIG. 5 are now explained from top to bottom, in which SGC, SGT, C_SGT and pump actuating cam lift are the same as already explained with reference to the timing chart of FIG. 4.

Designated by F_ErrChk in FIG. 5 is a flag signal generated by the ECU 150. In order to detect fuel pressure behaviors during execution of mounting error estimation process, the ECU 150 generates the flag signal F_ErrChk in such a manner that each high-level period of the flag signal F_ErrChk extends well over a low-lift period of the pump piston 145 of the high-pressure fuel pump 140. Specifically, in the internal combustion engine 101 of the first embodiment, the ECU 150 holds the flag signal F_ErrChk at a high level during periods from 5° CA BTDC to 105° CA ATDC of each cylinder (75° CA BTDC of the succeeding cylinder), or during periods of "27" to "2" and "9" to "20" in terms of the aforementioned count value C_SGT. During each high-level period of the flag signal F_ErrChk, the internal combustion engine 101 is under fuel-cut operating conditions during which the required quantity of fuel delivery is 0 and the fuel injectors 106 do not inject any fuel. This arrangement makes it possible to eliminate the influence of fuel pressure variations caused by injection of the fuel during execution of the mounting error estimation process.

When the internal combustion engine 101 is under the fuel-cut operating conditions, the required quantity of fuel delivery is 0 and, thus, the solenoid valve drive signal is normally at the high level to hold the solenoid valve 141 open. During execution of the mounting error estimation process, however, the solenoid valve drive signal is flipped to the low level to close the solenoid valve 141, as an exceptional case, the very moment that the flag signal F_ErrChk goes to the high level at 5° CA BTDC. In addition, low-level period of the solenoid valve drive signal (closed period of the solenoid valve 141) is increased by a solenoid valve open angle increment dlt_CA each time the solenoid valve drive signal goes to the low level up through the end of the mounting error estimation process. Therefore, opening timing of the solenoid valve 141 is successively retarded by increments of dlt_CA.

Accordingly, the timing of opening the solenoid valve 141 is obtained by adding the solenoid valve open angle increment dlt_CA to a preceding solenoid valve open angle CAop_old until the mounting error estimation process is finished. Thus, the solenoid valve open angle CAop is determined as follows:

$$CAop=CAop_old+dlt_CA \quad (2)$$

The solenoid valve open angle increment dlt_CA mentioned above corresponds to resolution of estimating the mounting error. In the example of FIG. 5, the solenoid valve open angle increment dlt_CA is set to 7.5° CA. The smaller the value of the solenoid valve open angle increment dlt_CA, the longer period of time the mounting error estimation process takes. Nevertheless, it is possible to obtain the estimated mounting error angle CAerr used in the aforementioned equation (1) by the mounting error estimation process.

Although the mounting error estimation process is carried out in a continuous sequence up through the completion thereof in the example shown in FIG. 5, the mounting error estimation process may be temporarily interrupted depending on operating conditions of the internal combustion engine 101. In case the mounting error estimation process is interrupted, it is preferable that the preceding solenoid valve open angle CAop_old be stored in the unillustrated memory of the ECU 150, for example. This would make it possible to resume the mounting error estimation process using the previously estimated solenoid valve open angle CAop and execute the mounting error estimation process in an efficient manner as a whole.

At the very beginning of the mounting error estimation process, no value of the preceding solenoid valve open angle CAop_old of equation (2) above is available and, thus, it is necessary that the solenoid valve drive signal begin to vary from a condition in which the quantity of fuel delivered from the high-pressure fuel pump 140 is zero regardless of the amount of the mounting error. For this reason, the solenoid valve open angle CAop should initially be set to a value advanced by as much as the mounting error from the lift start position of the pump actuating cam 146 when there is no mounting error to allow for a delay in the response of the solenoid valve 141.

Assuming, for example, that an allowance to be taken for the delay in the response of the solenoid valve 141 from 20° CA ATDC which is obtained by advancing the lift start position of 30° CA ATDC when there is no mounting error by a mounting error of 10° CA is 10° CA in the first embodiment, the solenoid valve drive signal should be turned to the low level to open the solenoid valve 141 at 10° CA ATDC. Thus, the solenoid valve open angle CAop is set to an initial value of 15° CA to cover an angular range of 5° CA BTDC to 10° CA ATDC. Consequently, when the solenoid valve open angle increment dlt_CA is set to 7.5° CA, the initial value of the preceding solenoid valve open angle CAop_old is to be set to 7.5° CA.

Since the closed period of the solenoid valve 141 gradually increases in steps of the solenoid valve open angle increment dlt_CA starting from each 5° CA BTDC point as indicated by equation (2) above up to the completion of the mounting error estimation process, it is possible to vary the solenoid valve drive signal from a state in which the quantity of fuel delivered from the high-pressure fuel pump 140 is zero to a state in which the high-pressure fuel pump 140 begins to deliver the fuel.

Designated by F_FPsmp in FIG. 5 is a fuel pressure sampling signal generated by the ECU 150. The ECU 150 samples the fuel pressure Fp within the delivery pipe 163 detected by the pressure sensor 164 when the fuel pressure sampling signal F_FPsmp is at a high level.

Specifically, in the internal combustion engine 101 of the first embodiment, the ECU 150 holds the fuel pressure sampling signal F_FPsmp at the high level to sample a sensing signal Fp of the pressure sensor 164 during periods from 5° CA BTDC to 5° CA ATDC of each cylinder, or during periods of "27" to "28" and "9" to "10" in terms of the count value C_SGT, and during periods from 95° CA ATDC to 105° CA ATDC of each cylinder (from 85° CA BTDC to 75° CA BTDC of the succeeding cylinder), or during periods of "1" to "2" and "19" to "20" in terms of the count value C_SGT.

Designated by F_ErrCal in FIG. 5 is a lift position detection complete signal output from the ECU 150 each time detection of the lift position of the pump actuating cam 146 is completed. Specifically, when a change in detected values of the fuel pressure Fp within the delivery pipe 163 successively sampled at the fuel pressure sampling signal F_FPsmp becomes equal to or larger than a preset fuel pressure change judgment value FP_dlt (e.g., 0.1 MPa), the ECU 150 judges that the pump actuating cam 146 has begun to lift the pump piston 145 upward to deliver the fuel into the delivery pipe 163. In this case, the ECU 150 sets the lift position detection complete signal F_ErrCal to a high level.

Then, the ECU 150 calculates the estimated mounting error angle CAerr based on a difference between the solenoid valve open angle CAop detected at the point in time when the lift position detection complete signal F_ErrCal is set to the high level and a standard solenoid valve open angle CAstd which is a value of the solenoid valve drive signal level when the fuel pressure Fp varies in the absence of mounting errors. The standard solenoid valve open angle CAstd mentioned above is predefined based on experimental data obtained in a design stage, for instance.

Figure 6:
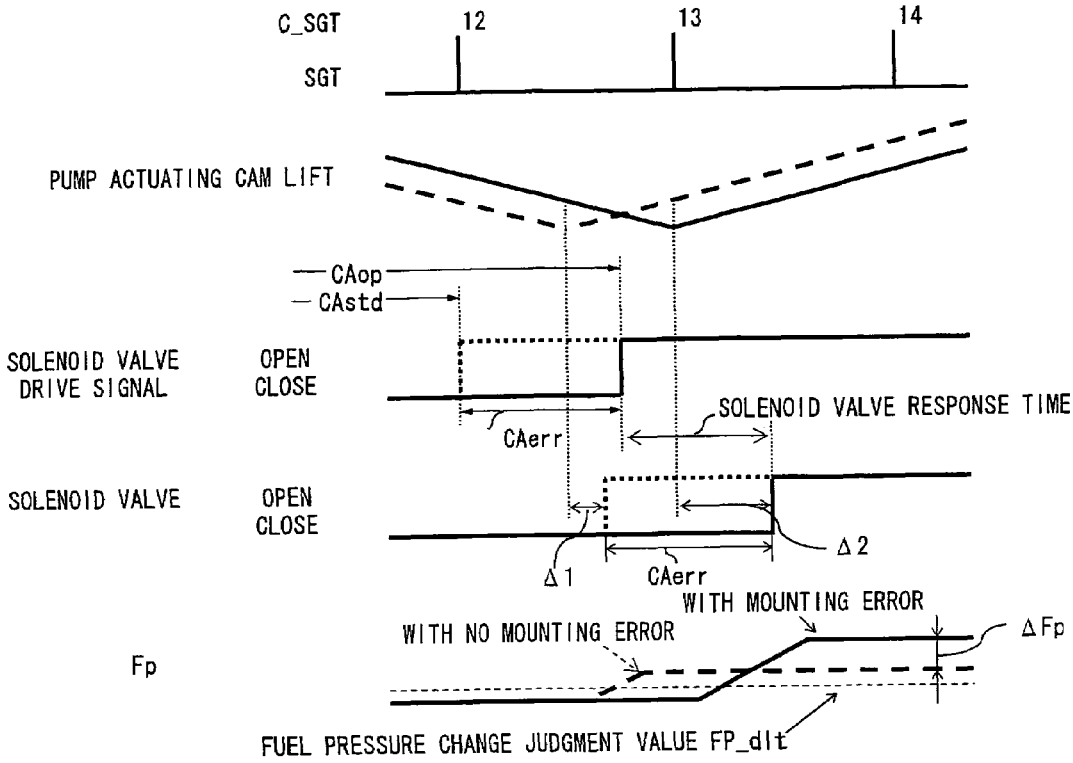
FIG. 6 is a fragmentary enlarged view of the timing chart of FIG. 5.

Next, the mounting error estimation process performed for estimating the mounting error occurring between the high-pressure fuel pump 140 and the pump actuating cam 146 is explained in further detail referring to FIG. 6.

FIG. 6 is a fragmentary enlarged view of FIG. 5 showing details of the mounting error estimation process approximately in a time range of "12" to "14" in terms of the count value C_SGT for the second cylinder in which the internal combustion engine 101 is in a condition where the pump actuating cam 146 just lifts the pump piston 145 upward causing the high-pressure fuel pump 140 to begin delivering the fuel into the delivery pipe 163. FIG. 6 also shows by broken lines behaviors of the parameters observed when there is no mounting error between the high-pressure fuel pump 140 and the pump actuating cam 146.

As indicated by the aforementioned equation (2), when the solenoid valve open angle CAop is successively altered by varying the solenoid valve drive signal, the closed period of the solenoid valve 141 becomes gradually longer with the opening point of the solenoid valve 141 shifting toward the retarding side with some delay time in the response of the solenoid valve 141 though. Even if the solenoid valve 141 is in the closed position, the high-pressure fuel pump 140 does not output the fuel unless the pump actuating cam 146 has begun to lift the pump piston 145 of the high-pressure fuel pump 140. If, however, when the closed period of the solenoid valve 141 becomes gradually longer and overlaps with a period in which the pump actuating cam 146 begins to lift the pump piston 145 of the high-pressure fuel pump 140 as shown in FIG. 6, the high-pressure fuel pump 140 begins to discharge the fuel at a point in time when the closed period of the solenoid valve 141 overlaps with the period of lifting of the pump actuating cam 146.

As a result, the fuel pressure Fp within the delivery pipe 163 rises and the amount of change in the fuel pressure Fp is detected by the pressure sensor 164. Therefore, if the fuel pressure change judgment value FP_dlt is properly preset, the ECU 150 can determine the solenoid valve open angle CAop at a point in time when the change in the fuel pressure Fp becomes equal to or larger than the fuel pressure change judgment value FP_dlt.

For the case where there is no mounting error between the high-pressure fuel pump 140 and the pump actuating cam 146, on the other hand, the solenoid valve open angle CAop at a point in time when the high-pressure fuel pump 140 begins to discharge the fuel and the amount of change in the fuel pressure Fp becomes equal to or larger than the fuel pressure change judgment value FP_dlt is determined by an experiment beforehand, for instance, in a similar fashion and experimental data obtained is stored as the standard solenoid valve open angle CAstd in the unillustrated memory of the ECU 150.

Accordingly, the ECU 150 calculates the estimated mounting error angle CAerr based on the solenoid valve open angle CAop obtained by the aforementioned mounting error estimation process and the standard solenoid valve open angle CAstd previously registered in the memory by using equation (3) below:

$$CAerr=CAop-CAstd \quad (3)$$

Since the standard solenoid valve open angle CAstd is used as a reference value, it is possible to cancel out the influence of delay time in the response of the solenoid valve 141 and correct for the mounting error even if there is a delay in the response of the solenoid valve 141.

A procedure for calculating the estimated mounting error angle CAerr in the aforementioned mounting error estimation process is described in the following. Before specifically discussing this calculating procedure, overall fuel supply operation performed by the ECU 150 in synchronism with the cam signal SGC is described with reference to a flowchart of FIG. 7.

First, the ECU 150 judges in step S101 whether the current count value C_SGT is either "9" or "27". If the count value C_SGT is neither "9" nor "27", the ECU 150 skips to step S110. In step S102, the ECU 150 performs fuel injection quantity calculating operation in which the ECU 150 calculates the quantity of fuel to be injected according to current operating conditions of the internal combustion engine 101 and also judges whether to run the internal combustion engine 101 in fuel-cut operation mode.

In step S103, the ECU 150 performs fuel delivery quantity calculating operation in which the ECU 150 calculates a target fuel pressure according to the current operating conditions of the internal combustion engine 101 and calculates the required fuel delivery quantity based on the fuel pressure Fp and the quantity of fuel to be injected. Then, in step S104, the ECU 150 initially sets a flag F_ErrChk="0".

Subsequently, the ECU 150 judges in step S105 whether to run the internal combustion engine 101 in the fuel-cut operation mode and, in step S106, whether the required fuel delivery quantity is "0". Only when the judgment results in steps S105 and S106 are in the affirmative, the ECU 150 sets a flag F_ErrChk="1" in step S107. Otherwise, the flag F_ErrChk="0" is maintained and, in this case, the mounting error estimation process detailed in the following is not carried out.

In step S108, the ECU 150 judges whether flag F_ErrChk="0". If flag F_ErrChk="0" in step S108, the below-described mounting error estimation process is not carried out and, thus, the ECU 150 controls the solenoid valve drive signal by normal solenoid valve control operation. Then, in step S110, the ECU 150 judges whether flag F_ErrChk="1".

If flag F_ErrChk="1" in step S110, the ECU 150 proceeds to step S111 to carry out the mounting error estimation process, in which the ECU 150 gradually increases the solenoid valve open angle CAop according to the aforementioned equation (2) to determine the value of the solenoid valve open angle CAop when the amount of change in the fuel pressure Fp becomes equal to or larger than the fuel pressure change judgment value FP_dlt and, then, calculates the estimated mounting error angle CAerr based on the aforementioned equation (3). The mounting error estimation process is now described in detail below.

Figure 7:
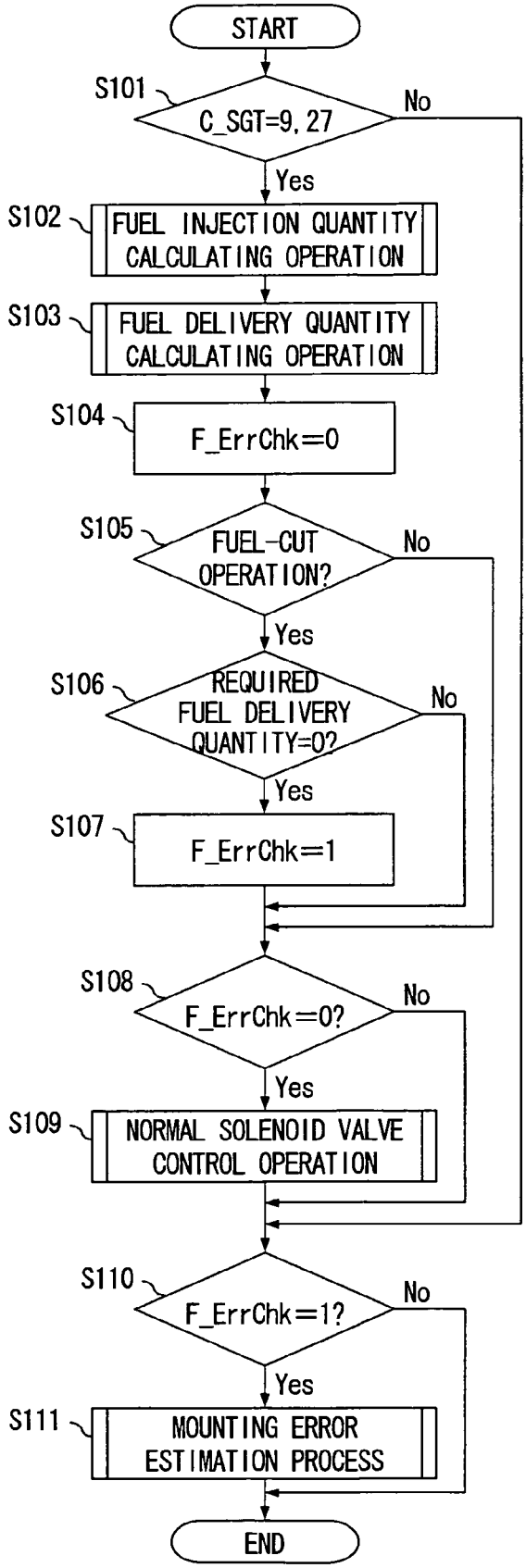
FIG. 7 is a flowchart showing overall fuel supply operation performed by an electronic control unit of the first embodiment.
Figure 8:
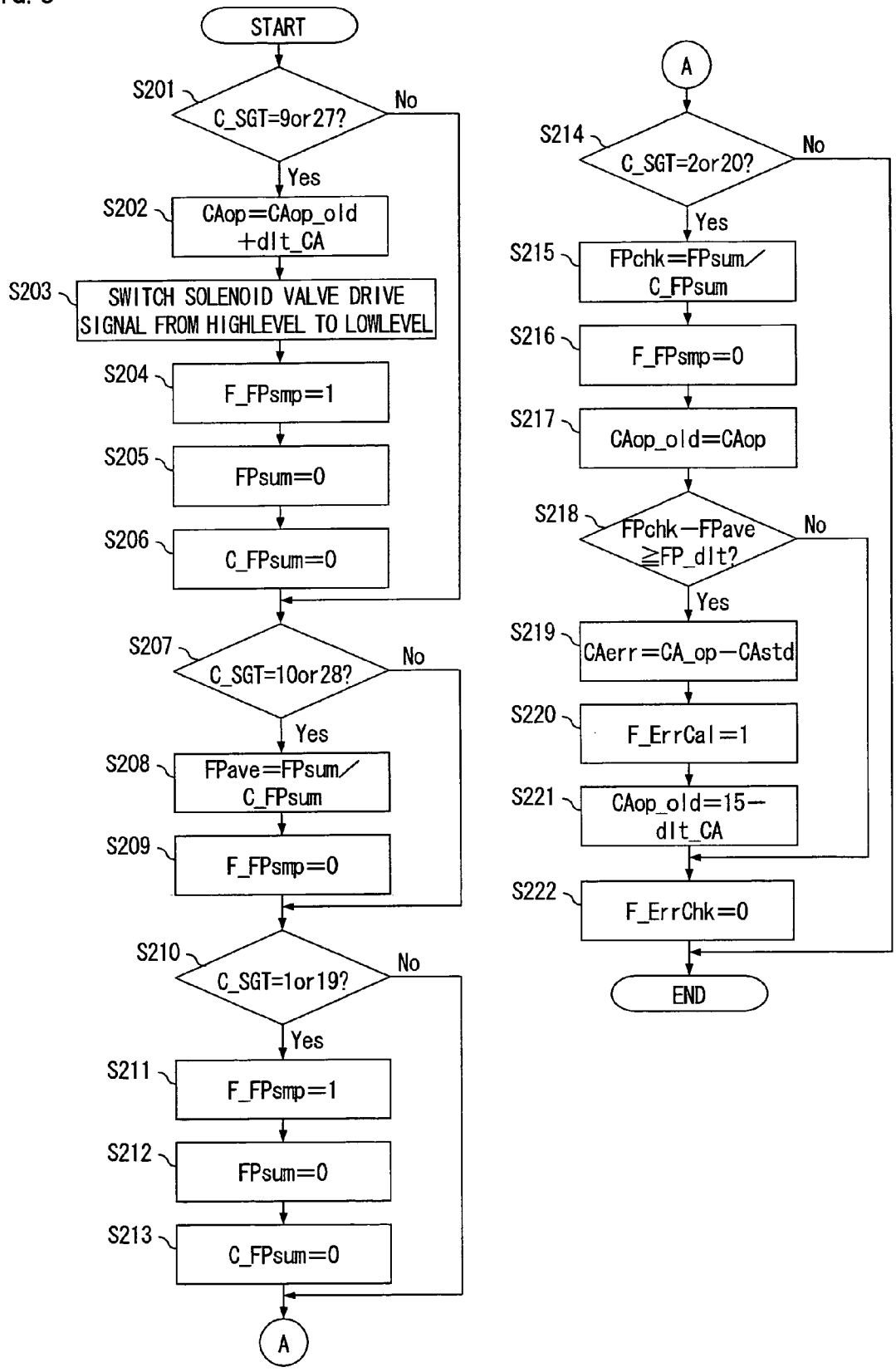
FIG. 8 is a flowchart showing the mounting error estimation process performed by the electronic control unit of the first embodiment.
Figure 9:
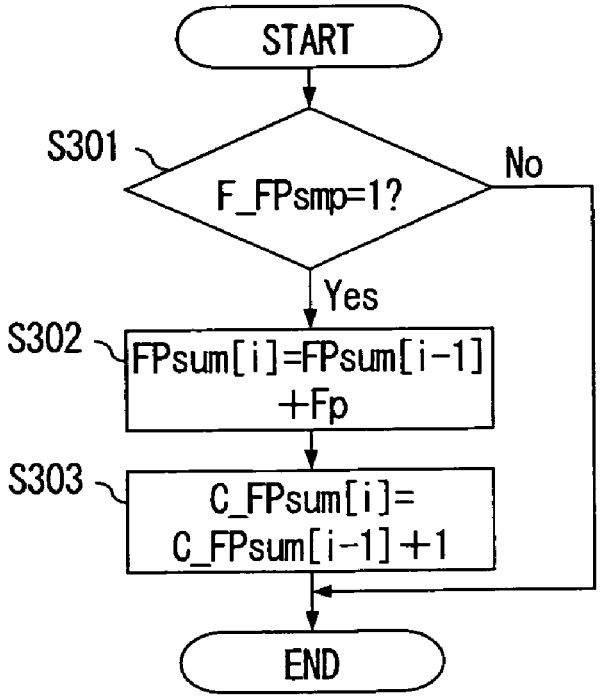
FIG. 9 is a flowchart showing the mounting error estimation process performed at 1-millisecond intervals by the electronic control unit of the first embodiment.

FIGS. 8 and 9 are flowcharts specifically showing step-by-step procedures of the mounting error estimation process performed by the ECU 150 in step S111 of FIG. 7. To be more specific, FIG. 8 is a flowchart showing the mounting error estimation process performed in synchronism with the crank angle signal SGT, and FIG. 9 is a flowchart showing the mounting error estimation process performed at 1-millisecond intervals.

First, the ECU 150 judges in step S201 whether the current count value C_SGT is either "9" or "27". If the count value C_SGT is neither "9" nor "27", the ECU 150 skips to step S207.

In step S202, the ECU 150 calculates the solenoid valve open angle CAop and thereby determines the low-level period of the solenoid valve drive signal (or the opening timing of the solenoid valve 141).

In step S203, the ECU 150 switches the solenoid valve drive signal from the high level to the low level. Consequently, if the pump actuating cam 146 lifts the pump piston 145 of the high-pressure fuel pump 140 upward during the closed period of the solenoid valve 141, the high-pressure fuel pump 140 delivers the fuel into the delivery pipe 163.

In step S204, the ECU 150 sets a flag F_FPsmp="1" to enable sampling of the fuel pressure Fp by the later-described mounting error estimation process performed at 1-millisecond intervals in order to calculate a standard fuel pressure FPave prior to the occurrence of a fuel pressure change. In succeeding steps S205 and S206, the ECU 150 resets variables FPsum and C_FPsum used for fuel pressure sampling to an initial value "0".

In step S207, the ECU 150 judges whether the current count value C_SGT is either "10" or "28". If the count value C_SGT is neither "10" nor "28", the ECU 150 skips to step S210.

If the count value C_SGT is "10" or "28" in step S207, the ECU 150 calculates the standard fuel pressure FPave in step S208 and, then, sets a flag F_FPsmp="0" in step S209 since a sampling period has finished.

In step S210, the ECU 150 judges whether the current count value C_SGT is either "1" or "19". If the count value C_SGT is neither "1" nor "19", the ECU 150 skips to step S214.

In step S211, the ECU 150 sets again the flag F_FPsmp="1" to enable sampling of the fuel pressure Fp by the later-described mounting error estimation process performed at 1-millisecond intervals in order to calculate fuel pressure FPchk to be used for judging whether the fuel pressure Fp has changed. In succeeding steps S212 and S213, the ECU 150 resets the variables FPsum and C_FPsum used for fuel pressure sampling to the initial value "0".

In step S214, the ECU 150 judges whether the current count value C_SGT is either "2" or "20". If the count value C_SGT is neither "2" nor "20", the ECU 150 finishes the mounting error estimation process at the current crank angle signal SGT.

In step S215, the ECU 150 calculates the fuel pressure FPchk for judging whether the fuel pressure Fp has changed and, then, sets the flag F_FPsmp="0" in step S216 since the sampling period has finished.

In step S217, the ECU 150 substitutes in the aforementioned equation (2) the solenoid valve open angle CAop for the preceding solenoid valve open angle CAop_old to be used next time in step S202.

In step S218, the ECU 150 judges whether a difference between the fuel pressure FPchk and the standard fuel pressure FPave is equal to or larger than the fuel pressure change judgment value FP_dlt. If the judgment result is in the negative, the ECU 150 skips to step S222.

In step S219, the ECU 150 calculates the estimated mounting error angle CAerr from the solenoid valve open angle CAop obtained in the current mounting error estimation process and the standard solenoid valve open angle CAstd stored in the memory of the ECU 150, and in step S220, the ECU 150 sets the flag F_ErrChk="1" since calculation of the estimated mounting error angle CAerr has been completed. Further, in step S221, the ECU 150 initializes the preceding solenoid valve open angle CAop_old in the memory in preparation for reexecution of the mounting error estimation process.

Since the current mounting error estimation process is now completed, the ECU 150 sets the flag F_ErrChk="0" in step S222 and finishes the mounting error estimation process at this point.

Referring now to FIG. 9, the mounting error estimation process performed at 1-millisecond intervals is described. In step S301, the ECU 150 judges whether flag F_FPsmp="1". If flag F_FPsmp="1" in step S301, fuel pressure sampling is currently enabled and, thus, the ECU 150 adds the detected value of the fuel pressure Fp to the value of FPsum in step S302 and increments the number of accumulations C_FPsmp by 1 in step S303, where the ECU 150 finishes the mounting error estimation process. If the flag F_FPsmp is other than "1" in step S301, the ECU 150 finishes the mounting error estimation process without performing any operation.

In the example shown in FIG. 5, the mounting error estimation process is in progress and the internal combustion engine 101 is under fuel-cut operating conditions in which the required quantity of fuel delivery is 0 and the fuel injectors 106 do not inject any fuel. Thus, the ECU 150 first sets the flag F_ErrChk="1" at a point of count value C_SGT="27" where the piston in the first cylinder is at 5° CA BTDC.

Since the ECU 150 now performs a first sequence of mounting error estimation, the preceding solenoid valve open angle CAop_old is currently 7.5° CA. Thus, the solenoid valve open angle CAop is calculated to be 15° CA by adding the solenoid valve open angle increment dlt_CA (7.5° CA) to the preceding solenoid valve open angle CAop_old of 7.5° CA and, then, the ECU 150 determines the low-level period of the solenoid valve drive signal (or the opening timing of the solenoid valve 141) and switches the solenoid valve drive signal from the high level to the low level.

Also, the ECU 150 sets the flag F_FPsmp="1" and holds the same up to a point of count value C_SGT="28" and calculates the standard fuel pressure FPave prior to the occurrence of a fuel pressure change.

Next, the ECU 150 sets again the flag F_FPsmp="1" at a point of count value C_SGT="1" where the piston in the third cylinder is at 85° CA BTDC and holds the flag F_FPsmp="1" up to a point of count value C_SGT="2" and, then, the ECU 150 calculates the fuel pressure FPchk used for judging whether the fuel pressure Fp has changed.

At the point of count value C_SGT="2", the ECU 150 substitutes in the aforementioned equation (2) the solenoid valve open angle CAop for the preceding solenoid valve open angle CAop_old. While the ECU 150 then calculates the difference between the obtained fuel pressure FPchk and the standard fuel pressure FPave at this point, the difference is still less than the fuel pressure change judgment value FP_dlt. Therefore, the ECU 150 sets the flag F_ErrChk="0" and finishes the current sequence of the mounting error estimation process.

As a second sequence of mounting error estimation, the ECU 150 sets the flag F_ErrChk="1" at a point of count value C_SGT="9" where the piston in the third cylinder is at 5° CA BTDC. Since the preceding solenoid valve open angle CAop_old is now 15° CA, the solenoid valve open angle CAop is calculated to be 22.5° CA and the ECU 150 performs the same operation as in the preceding sequence of mounting error estimation. Since there is still no change in the fuel pressure Fp in this sequence either, the ECU 150 again sets the flag F_ErrChk="0" and finishes the current sequence of the mounting error estimation process.

Then, as a third sequence of mounting error estimation, the ECU 150 sets the flag F_ErrChk="1" at a point of count value C_SGT="27" where the piston in the fourth cylinder is at 5° CA BTDC. Since the preceding solenoid valve open angle CAop_old is now 22.5° CA, the solenoid valve open angle CAop is calculated to be 30° CA and the ECU 150 performs the same operation as in the preceding sequence of mounting error estimation. Since there is still no change in the fuel pressure Fp in this sequence either, the ECU 150 again sets the flag F_ErrChk="0" and finishes the current sequence of the mounting error estimation process.

Now, as a fourth sequence of mounting error estimation, the ECU 150 sets the flag F_ErrChk="1" at a point of count value C_SGT="9" where the piston in the second cylinder is at 5° CA BTDC. Since the preceding solenoid valve open angle CAop_old is now 30° CA, the solenoid valve open angle CAop is calculated to be 37.5° CA and the ECU 150 performs the same operation as in the preceding sequence of mounting error estimation.

In this sequence of mounting error estimation, the ECU 150 calculates the difference between the obtained fuel pressure FPchk and the standard fuel pressure FPave at a point of count value C_SGT="20". Since the difference is now equal to or larger than the fuel pressure change judgment value FP_dlt, the ECU 150 calculates the estimated mounting error angle CAerr. If the standard solenoid valve open angle CAstd stored in the memory of the ECU 150 is 30° CA, the estimated mounting error angle CAerr becomes 7.5° CA as the solenoid valve open angle CAop is currently 37.5° CA.

The ECU 150 now sets the flag F_ErrChk="1" since calculation of the estimated mounting error angle CAerr has been completed. Further, the ECU 150 initializes the preceding solenoid valve open angle CAop_old in the memory to 7.5° CA in preparation for reexecution of the mounting error estimation process, sets the flag F_ErrChk="0" and finishes the current sequence of the mounting error estimation process.

Although the phase angle of the camshaft 110 does not vary relative to the crankshaft 120 in the first embodiment, the above-described arrangement of the first embodiment is also applicable to a four-cylinder direct injection internal combustion engine of which camshaft is provided with a variable valve timing mechanism. In this case, the fuel supply system of the embodiment can perform the same control operation as in the foregoing discussion if controlled to execute the mounting error estimation process only when the variable valve timing mechanism does not operate.

Also, while the solenoid valve 141 is actuated in a controlled fashion by using the crank angle signal SGT as a rotation signal in the foregoing first embodiment, the cam signal SGC may be used as a rotation signal for controlling the solenoid valve 141 if the configuration of the fuel supply system is such that the camshaft 110 is fitted with a signal plate 111 which generates a multi-pulse cam signal SGC or the crankshaft 120 is not fitted with any signal plate 121 and only the cam signal SGC generated by the signal plate 111 is available. In this alternative configuration, it is possible to eliminate the influence of the mechanical motion transfer means (e.g., the timing belt 113) because the signal plate 111 and the pump actuating cam 146 are mounted on the camshaft 110.

Furthermore, although a correction is made to cancel out the influence of delay time in the response of the solenoid valve 141 by subtracting the standard solenoid valve open angle CAstd stored in the memory from the solenoid valve open angle CAop to obtain the estimated mounting error angle CAerr as indicated in the aforementioned equation (3) in the first embodiment, the mounting error may be corrected in a different way.

For example, if the delay time in the response of the solenoid valve 141 varies with a supply voltage (battery voltage) applied to the solenoid valve 141 or with the fuel pressure, the estimated mounting error angle CAerr may be calculated by equation (4) below:

$$CAerr=CAop_real-CAstd_real \quad (4)$$

where CAop_real is a crank angle at which the solenoid valve 141 actually opens that is calculated by adding the response time of the solenoid valve 141 corrected by the supply voltage or by the fuel pressure and converted into a crank angle by engine speed (rpm) to the solenoid valve open angle CAop, and CAstd_real is a standard actual opening angle of the solenoid valve 141 used instead of the standard solenoid valve open angle CAstd of equation (3) that is stored in the memory of the ECU 150.

Second Embodiment

While the corrected solenoid valve open angle CAop at which the required quantity of fuel delivery is obtained is calculated from equation (1) by directly using the estimated mounting error angle CAerr calculated by the aforementioned equation (3) in the first embodiment, it is preferable to correct the estimated mounting error angle CAerr based on the fuel pressure (e.g., the standard fuel pressure FPave) at each point in time.

Figure 10:
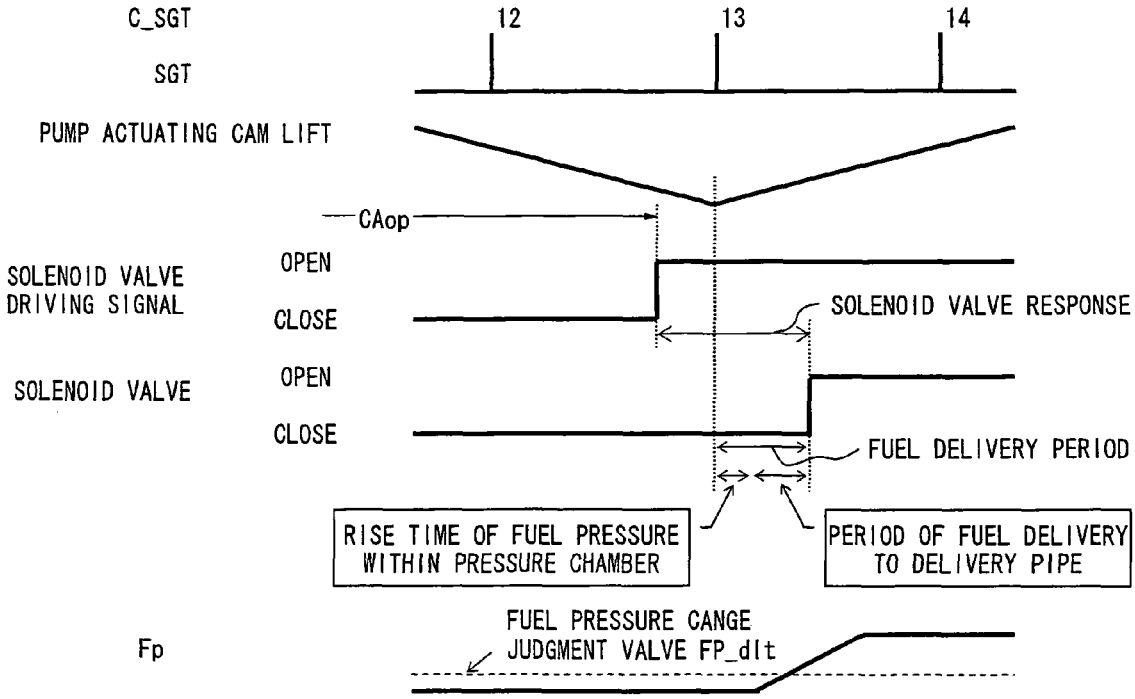
FIG. 10 is a timing chart showing fuel pressure behaviors at around a point where a high-pressure fuel pump begins to deliver fuel according to a second embodiment of the invention.

Specifically, although the period in which the solenoid valve 141 is in the closed position and the pump actuating cam 146 lifts the pump piston 145 upward is regarded as a fuel delivery period in the first embodiment, a detailed examination of this period shown in FIG. 10 indicates that the fuel pressure within the pressure chamber 142 of the high-pressure fuel pump 140 becomes equal to the fuel pressure Fp within the delivery pipe 163 in a first portion of that period and, thereafter, the high-pressure fuel pump 140 delivers the fuel into the delivery pipe 163.

Therefore, the higher the fuel pressure Fp within the delivery pipe 163, the longer a rise time of the fuel pressure within the pressure chamber 142 in the aforementioned period. For this reason, the relationship between the mounting error between the high-pressure fuel pump 140 and the pump actuating cam 146 and the solenoid valve open angle CAop at which the high-pressure fuel pump 140 begins to deliver the fuel varies with the fuel pressure.

There is a similar relationship between the mounting error and the standard solenoid valve open angle CAstd. Thus, in a second embodiment of the invention, values of the standard solenoid valve open angle CAstd for different values of the fuel pressure are stored in the memory of the ECU 150 in advance and the ECU 150 sets the standard solenoid valve open angle CAstd corresponding to the actual fuel pressure detected based on a sensing signal output from the pressure sensor 164 in the calculation of the estimated mounting error angle CAerr. This arrangement of the second embodiment makes it possible to correct the estimated mounting error angle CAerr for fuel pressure changes and thereby compensate for the mounting error between the high-pressure fuel pump 140 and the pump actuating cam 146 with even higher accuracy.

To implement the aforementioned arrangement of the second embodiment, the standard solenoid valve open angle CAstd used in step S219 of FIG. 8 should be set to a value corresponding to the current standard fuel pressure FPave calculated in step S208, for instance. To give one specific example, if the standard solenoid valve open angle CAstd is 30° CA when the standard fuel pressure FPave is 3 MPa, the standard solenoid valve open angle CAstd should be set to 25.5° CA when the standard fuel pressure FPave is 10 MPa. Values of the standard solenoid valve open angle CAstd for values of the standard fuel pressure FPave between 3 MPa and 10 MPa where necessary.

Third Embodiment

Referring again to FIG. 6, it is recognized from examination of how the fuel pressure Fp varies that the fuel pressure Fp is higher when there is a mounting error between the high-pressure fuel pump 140 and the pump actuating cam 146 (shown by solid lines) than when there is no mounting error (shown by broken lines). This is because the solenoid valve open angle increment dlt_CA which determines the mounting error estimating resolution is larger than the mounting error actually occurring between the high-pressure fuel pump 140 and the pump actuating cam 146.

Specifically, the solenoid valve open angle increment dlt_CA is set to 7.5° CA when there is a mounting error of 5° CA toward the retarding side in the aforementioned example of the first embodiment illustrated in FIG. 5. Thus, the fuel delivery period ?2 when there is this mounting error is longer than the fuel delivery period ?1 when there is no mounting error as can be seen from FIG. 6.

According to a third embodiment of the invention, the ECU 150 calculates a fuel pressure difference (i.e., the amount of fuel pressure change) ?Fp from the sensing signal output from the pressure sensor 164 when there is a mounting error between the high-pressure fuel pump 140 and the pump actuating cam 146 (shown by solid lines) and when there is no mounting error (shown by broken lines) and corrects the estimated mounting error angle CAerr calculated by equation (3) based on the fuel pressure difference ?Fp thus obtained. With this arrangement of the third embodiment, the solenoid valve open angle CAop can be determined from equation (1) with even higher accuracy.

While the invention has thus far been described, by way of example, with reference to the first to third embodiments in which the invention is applied to the fuel supply system of the four-cylinder direct injection internal combustion engine 101, the invention is not limited thereto. It should be apparent to those skilled in the art that the invention is also applicable to other internal combustion engines than the four-cylinder type. Furthermore, although the pump actuating cam 146 has four lobes (projections) as illustrated in FIG. 4, the invention is not limited to this structure of the pump actuating cam 146. Also, although the ECU 150 calculates the estimated mounting error angle CAerr in each execution cycle of the mounting error estimation process in the foregoing embodiments, the mounting error does not change so rapidly that the mounting error may be stored in the memory of the ECU 150 even after the internal combustion engine 101 is stopped or may be subjected to an averaging process.

Moreover, although the high-pressure fuel pump 140 delivers the fuel in a first half of rotation of the pump actuating cam 146 according to the foregoing discussion, the high-pressure fuel pump 140 delivers the fuel in a second half of rotation of the pump actuating cam 146. In this latter case, the solenoid valve 141 must be opened immediately before the lift start position of the pump actuating cam 146 and the quantity of fuel delivered by the high-pressure fuel pump 140 is to be controlled by the timing of solenoid valve closing angle and not the timing of solenoid valve open angle.

In this case, the same advantageous effects as produced by the aforementioned embodiments can be obtained by shifting the timing of the solenoid valve closing angle toward an advancing side from around the lift start position of the pump actuating cam 146 at which the quantity of fuel delivered by the high-pressure fuel pump 140 becomes "0" during execution of the mounting error estimation process.

The fuel supply system of the present invention can be applied to a wide range of direct injection internal combustion engines including not only direct injection gasoline engines but also diesel engines in which pressurized fuel is injected from a delivery pipe directly into combustion chambers.

What is claimed is:

1. A fuel supply system of an internal combustion engine, said fuel supply system comprising:

a delivery pipe for feeding pressurized fuel to fuel injectors for respectively injecting the fuel into each cylinder of said engine;

a high-pressure fuel pump driven by movements of a pump actuating cam which is caused to rotate by energy imparted by said engine for delivering the pressurized fuel into said delivery pipe;

a solenoid valve for regulating the quantity of fuel delivered by said high-pressure fuel pump;

a fuel pressure sensor for detecting fuel pressure within said delivery pipe;

a rotation signal generator for generating a rotation signal in accordance with rotation of said engine;

a solenoid valve controller for generating a solenoid valve drive signal for controlling opening/closing behavior of said solenoid valve using said rotation signal as a reference so that said high-pressure fuel pump delivers a quantity of fuel appropriate for current operating conditions of said engine; and a mounting error estimator for transferring said engine from a state in which said high-pressure fuel pump does not deliver any pressurized fuel to a state in which said high-pressure fuel pump begins to deliver the pressurized fuel by gradually varying a solenoid valve drive signal output period while monitoring changes in the fuel pressure detected by said fuel pressure sensor, and for estimating a mounting error between angular mounting positions of said high-pressure fuel pump and said pump actuating cam with reference to said rotation signal from a state of said solenoid valve drive signal when a change in the fuel pressure has been detected;

wherein said solenoid valve controller makes a correction to said solenoid valve drive signal in accordance with the value of the mounting error estimated by said mounting error estimator.

2. The fuel supply system according to claim 1 wherein a period during which said mounting error estimator monitors changes in the fuel pressure detected by said fuel pressure sensor is made equal to a period during which said fuel injectors are not actuated.

3. The fuel supply system according to claim 1 wherein said mounting error estimator corrects the estimated mounting error based on a delay in the response of said solenoid valve.

4. The fuel supply system according to claim 1 wherein said mounting error estimator estimates said mounting error under engine operating conditions where a small quantity of fuel delivery is required by the pump.

5. The fuel supply system according to claim 1 wherein said mounting error estimator estimates said mounting error when said engine is run under fuel-cut operation conditions where said fuel injectors are not actuated.

6. The fuel supply system according to claim 1 wherein said mounting error estimator corrects the estimated mounting error based on the fuel pressure detected at the beginning of fuel delivery from said high-pressure fuel pump.

7. The fuel supply system according to claim 1 wherein said mounting error estimator corrects the estimated mounting error based on the amount of change in the fuel pressure detected at the beginning of fuel delivery from said high-pressure fuel pump.

8. The fuel supply system according to claim 1 wherein said mounting error estimator performs mounting error estimation process in successive sequences, said solenoid valve controller stores a state of said solenoid valve drive signal in a memory each time the state of said solenoid valve drive signal varies and, when the mounting error estimation process is resumed, said solenoid valve controller begins to vary said solenoid valve drive signal from state of said solenoid valve drive signal stored in the memory in a preceding sequence.

9. The fuel supply system according to claim 1, wherein the solenoid valve drive signal output period is gradually varied by a predetermined amount.

10. The fuel supply system according to claim 9, wherein a mounting error is calculated based on a length of the solenoid valve drive signal output period when a change in the fuel pressure has been detected.

11. The fuel supply system according to claim 1, wherein said high-pressure fuel pump begins to deliver the pressurized fuel by gradually increasing the solenoid valve drive signal output period while monitoring changes in the fuel pressure detected by said fuel pressure sensor.

12. The fuel supply system according to claim 11, wherein the solenoid valve drive signal output period is gradually increased by a predetermined amount.

13. The fuel supply system according to claim 12, wherein a mounting error is calculated based on a length of the solenoid valve drive signal output period when a change in the fuel pressure has been detected.

* * * * *